United States Patent [19]

Heiler

[11] Patent Number: 4,651,349

[45] Date of Patent: Mar. 24, 1987

[54] MOTHER'S NURSING AID: BREAST-FEEDING SLING

[76] Inventor: Jacqueline K. Heiler, P.O. Box 451, Shearwater, Nova Scotia, Canada, B0J 3A0

[21] Appl. No.: 887,747

[22] Filed: Jul. 21, 1986

[51] Int. Cl.[4] ..... A41D 1/20

[52] U.S. Cl. ..... 2/104

[58] Field of Search ..... 2/104, 49 R

[56] References Cited

U.S. PATENT DOCUMENTS

| | | | |
|---|---|---|---|
| 4,528,699 | 7/1985 | Hughes | 2/104 |
| 4,566,136 | 1/1986 | Echols | 2/104 |
| 4,631,754 | 12/1986 | Ryan | 2/104 |

*Primary Examiner*—Doris L. Troutman

*Attorney, Agent, or Firm*—Ralph J. Broderick

[57] ABSTRACT

It is now generally accepted by the medical profession and by all informed mothers, that the natural breast-feeding of infants imparts many benefits, both physical and psychological, in infancy and thereafter, to the infant, the present invention provides uncomplicated and efficient means for all mothers, or wet nurses, to do so in all places, public or private, without embarrassment or attracting unnecessary attention, this invention consists of an apron-like device which is attached around the neck of the mother by strap means and is divided into three sections, the top section having an open screened aperture therein for viewing the infant while nursing, on each side of the top section a pocket is provided which holds a cloth for cleaning in case the nursing infant regurgitates while in burping process, the second section of this device is filled with soft material held in place by quilting and forms a sleeve to hold the arm of the mother while nursing, a pocket is provided on each side of the sleeve for tissues, the quilted bottom section is cut on a bias to provide comfortable support for the mother's arm and also acts as a cushion for the infant, the whole combination being completely machine washable for re-use.

1 Claim, 8 Drawing Figures

MOTHER'S NURSING AID: BREAST-FEEDING SLING

SPECIFICATION

Figure 1:
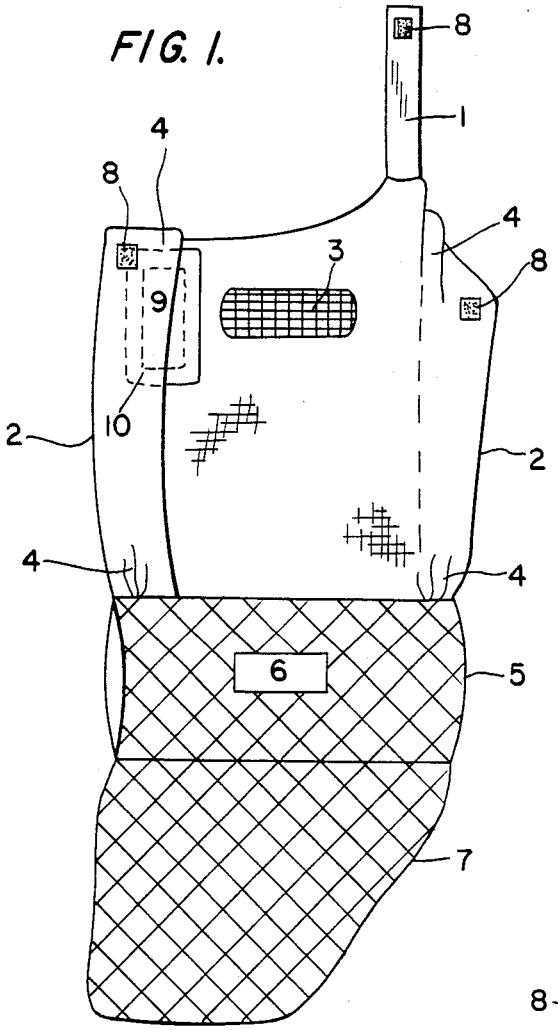

The present invention is devised for the use of nursing mothers and wet nurses and thus provides a novel solution for a universal need.

The invention consists of a device which provides means for the nursing of infants under all situations in public and private places and thus obviates the embarrassment often experienced by mothers and wet nurses who find it necessary to nurse an infant in public.

The invention is of particular interest at the present time in view of the medical fact that breast-feeding of an infant has been determined to provide many benefits, both physical and psychological, which affect the future development and health of an infant.

In the drawings which illustrate the embodiments of this invention and in which the same numbers are used to illustrate the same parts:

FIG. 1: Illustrates a pictorial view of the embodiments of this invention.

Figure 2:
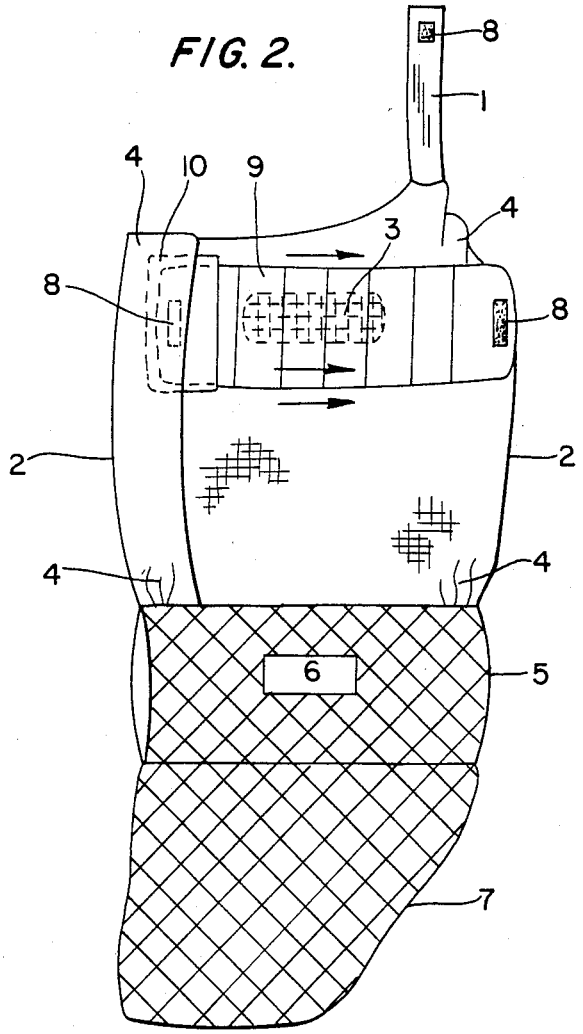

FIG. 2: Illustrates a pictorial view of the embodiments of this invention and shows the use of the burping cloth pulled across the screened aperture.

Figure 3:
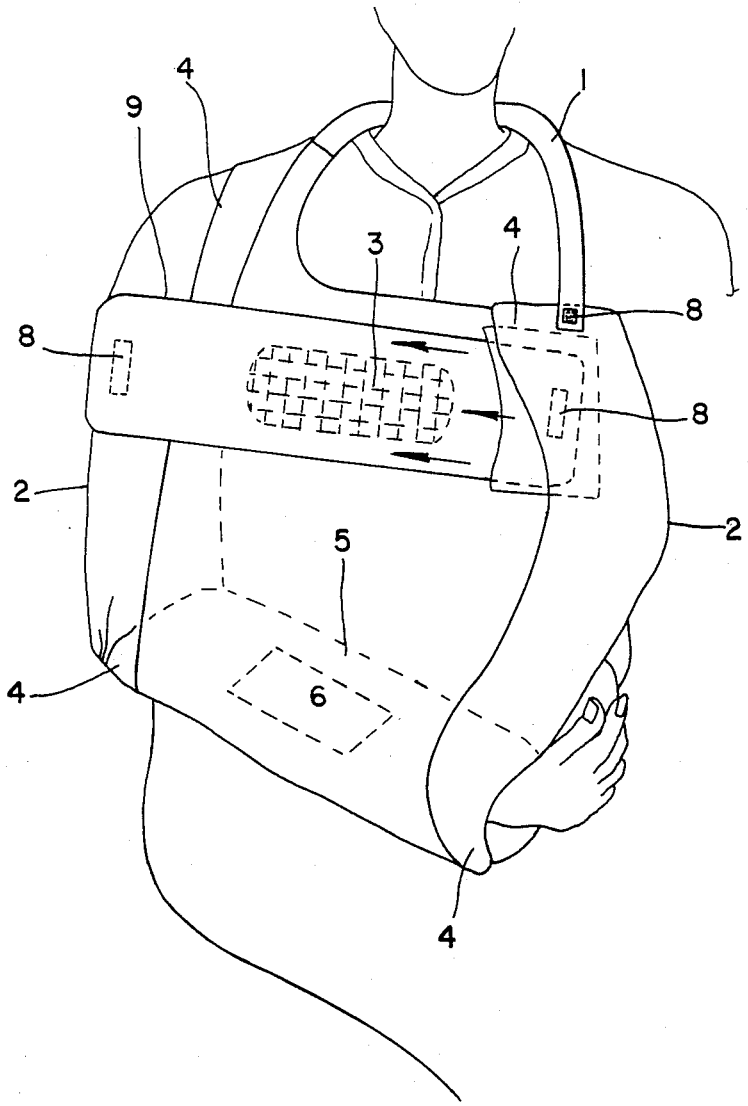

FIG. 3: Illustrates a pictorial depiction of the device in use by a nursing mother.

Figure 4:
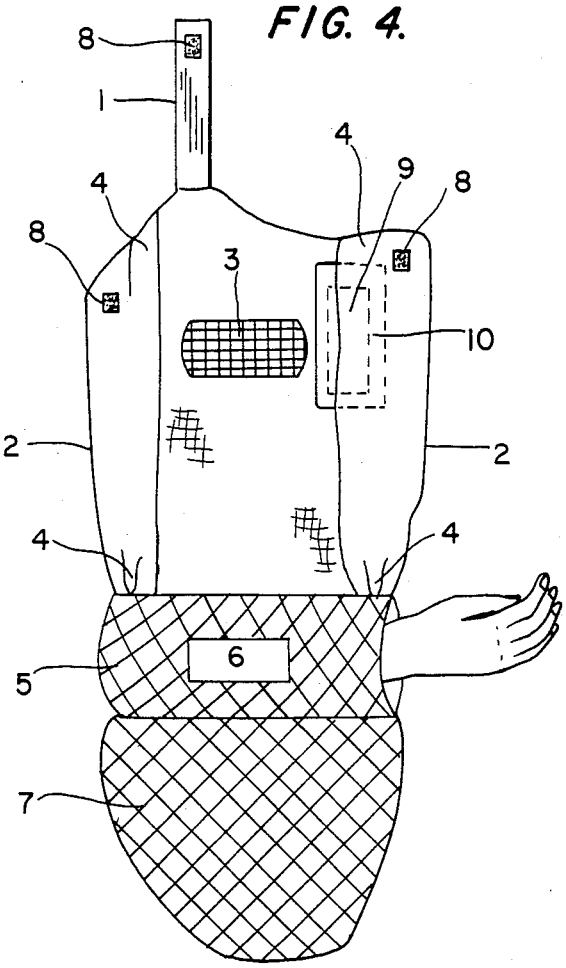

FIG. 4: Is a pictorial view illustrating the reverse side of FIGS. 1 and 2.

Figure 5:
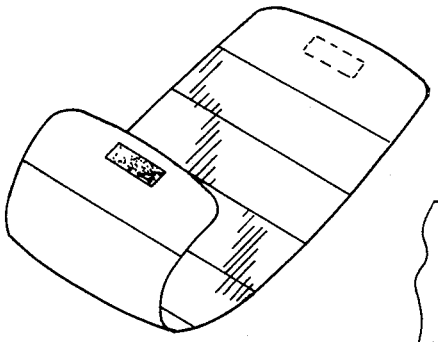

FIG. 5: Illustrates the burping cloth.

Figure 6:
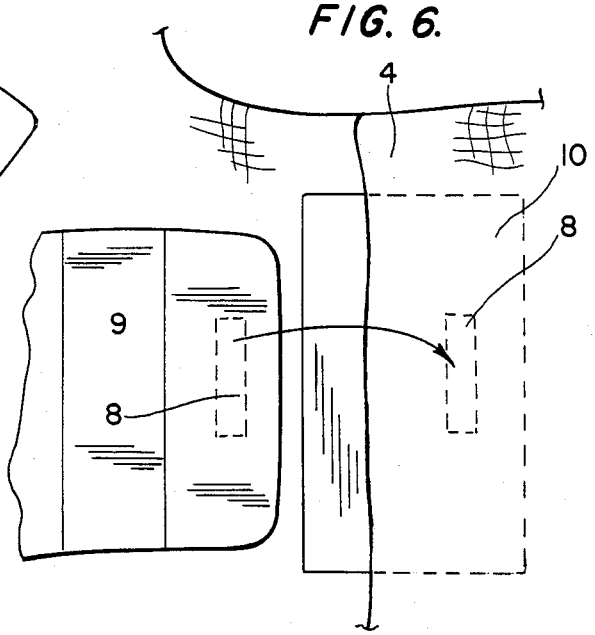

FIG. 6: Illustrates a detailed view of the burping cloth and of the pocket in which the burping cloth is stored when not in use.

Figure 7:
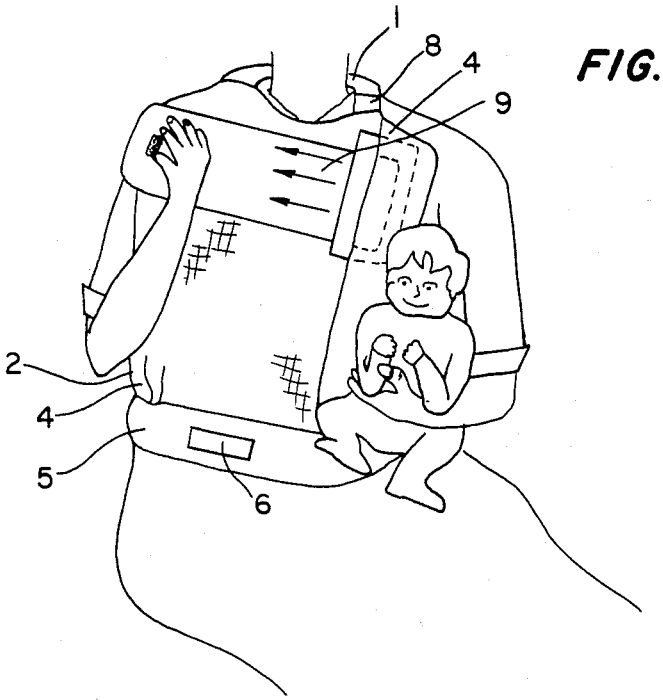

FIG. 7: Illustrates the device in use and particularly illustrates the use of the burping cloth pulled across te screened aperture and fastened in preparation for burping the infant.

Figure 8:
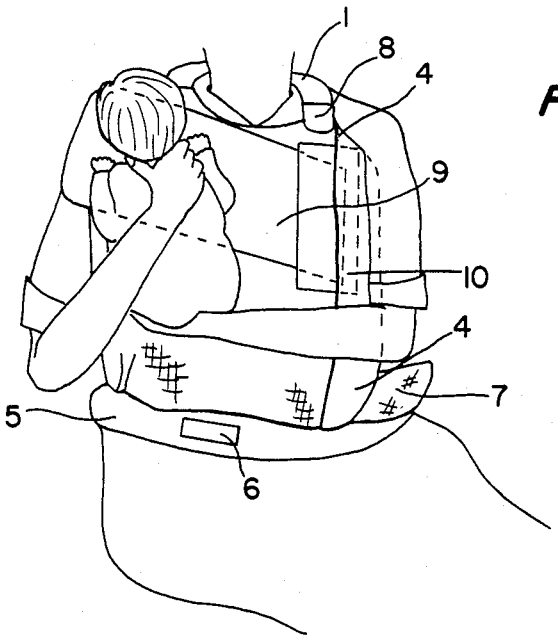

FIG. 8: Illustrates the burping process.

In the drawings, the number 1 illustrates the elasticized neck strap which holds the whole invention in place around the neck and on the body of the user. The number 2 illustrates the upper section of the invention which covers the chest and torso of the user. The number 3 illustrates the screened aperture through which the infant may be viewed while nursing. The number 4 illustrates the pleats in section 2 of the invention. The number 5 illustrates the quilted padded sleeve of the invention. The number 6 illustrates the pocket on the sleeve 5 which holds tissues such as Kleenex (Trade Mark). The number 7 illustrates the quilted padded section cut on a bias which folds over the knees of the user and under the infant and on which the infant rests. The number 8 illustrates the various pieces of loop-pile fasteners used and their positions on the various places. The number 9 illustrates the burping cloth. The number 10 illustrates the pocket in the upper part of the invention holding the cloth 9 which may be pulled across the aperture 3 as circumstances require and held in place by the loop-pile fasteners 8 on the shoulder of the invention. It may be noted that the invetion is reversible and that each side thereof is identical to the other side thereof. Another feature of the invention are the burping cloths 9 which help to prevent frequent washing of the invention in that the infant may soil or regurgitate only on the burping cloths 9 or only on one of the burping cloths 9 since the burping cloths 9 are detachable and interchangeable for both sides. The burping cloths 9 need only to be quickly loundered or simply rinsed and hung to dry until the next feeding. To use the burping cloths 9, place the infant in the comfortable and familiar surroundings of the invention (FIG. 3) engaging, for example, the right arm and breast first. After about 10 minutes of nursing, the user opens pocket 10 and pulls the folded burping cloth 9 across the screened aperture 3 and secures it by means of loop-pile fasteners to the opposite right shoulder, FIGS. 2 and 3. The user slides her right arm out of the sleeve section 5 of the device, all the while still holding the infant with her left arm. See FIGS. 7 and 8. Then, she takes the infant from underneath and inside the top section 2 of the device, to burp the infant on the burping cloth 9 located on the outside of the top section 2 before continuing on to the left breast. After burping the infant, the user simply flips the whole device over to the reverse side and follows the same above mentioned process, only now using the left arm in sleeve 5 and nurses on the left breast and when burping is necessary, brings infant to rest on the burping cloth 9, now situated on the outside of the top left shoulder. Afer the infant has been burped and if the burping cloth 9 has not been soiled, the burping cloth 9 is quickly, easily and conveniently folded back inside its pocket 10 attached thereto by loop-pile fasteners 8, so it does not fall out, and it is ready for the next use. The burping cloth 9 generally protects the whole device from soiling, enabling longer use of the whole device before washing of same is required.

The mode of use and the operation of this invention are as follows:

The user takes the elasticized strap 1, FIGS. 1, 2, 3 and 4, having loop-pile fasteners 8 or similar material on both sides of one end thereof and attaches it to the Velcro 8 on the opposite shoulder of the invention. The user then disposes the top section 2 of the invention having a screened aperture 3 therein, FIGS. 1, 2, 3 and 4 over her chest and body; which places the circular open padded quilted sleeve 5, which holds the pocket 6 for Kleenex (Trade Mark) or other tissue, in position to receive her fore-arm and folds the other padded section 7 over her knees. The user places the infant on the padded section 7 on her knees, where the infant is held in place by her fore-arm through the padded sleeve 5. The user may view the nursing infant at all times through the screened aperture 3, FIGS. 1, 2, 3, and 4 in the top section 2 of the invention, which is disposed over her chest, as she proceeds to nurse the infant. The top section 2 is provided with expandable pleats 4, FIGS. 1, 2, 3, 4, 6, 7 and 8 under each shoulder thereof and above the sleeve section 5 which provide for expansion for the growth of the infant. In case the infant regurgitates during feeding, the user may reach with her unoccupied hand to pull out the Kleenex (Trade Mark) or other tissue from the pocket 6, FIGS. 1, 2, 3 and 4 of the invention and then continues to nurse the infant, viewing the infant at all times through the screened aperture 3 in the top section 2 of the invention which allows only the mother at close range to view the infant but a person observing from a short distance away would not be able to see into the screened aperture 3, therefore providing optimum privacy for the nursing mother or wet nurse. When the user is finished nursing the infant, she disengages the neck strap 1 from around her neck, removes the combined invention from her body and folds or stores same until further use is required.

The above is my disclosure of my invention and discovery and as it is possible that my invention and discovery may be embodied in forms other than, or differing from, those set out in my present disclosure and specification, I claim as my invention and discovery all variations, modifications and other forms of this invention which may be justly deemed to fall within the scope of my appended claims.

The embodiments of my invention in which an exclusive property or privilege is claimed and on which I desire to obtain United States Letters Patent are defined as follows:

1. A device for breast-feeding infants, fabricated of any hypo-allerginic textile or other similar material, composed of three sections of the said material, the top section thereof consisting of a unitary piece of material, disposed and adapted to rest over the chest and torso of the user; the top section having attached thereto by means, a holding strap made of an elasticized material, adapted to fit around the neck of the user, one end of the strap being permanently attached by means to one side of the top of the said section, the other end of the strap being adapted to being removably attached to the other side of the top of the said section by loop-pile fasteners or similar means, an oblong rectangular pocket is provided on either side of the top section disposed and adapted to receive and hold an oblong rectangular cloth, the said cloth having pieces of loop-pile fastener attached by means thereto and the said pocket having pieces of loop-pile fastener disposed and adapted therein to receive and hold the pieces of Velcro on the cloth, the first section above described being attached by means to a hollow padded quilted sleeve, open at each end thereof and disposed and adapted to receive the fore-arm of the mother or wet nurse breast-feeding the infant, the said hollow padded quilted section being provided by means with a pocket on either exterior side thereof, the pocket being disposed and adspted to receive and hold tissues or other material and having a third padded quilted section, cut on the bias, attached by means to the second section.

* * * * *